US005576152A

United States Patent [19]

Hodge et al.

[11] Patent Number: 5,576,152

[45] Date of Patent: Nov. 19, 1996

[54] PHOTOGRAPHIC PAPER FORMED WITH LOW MOLECULAR WEIGHT POLYVINYL ALCOHOL HAVING LOW OXYGEN PERMEABILITY

[75] Inventors: Ian M. Hodge, Rochester; David J. Lacz, Honeoye Falls; Todd R. Skochdopole, Pittsford; Anita M. Fees, Rochester, all of N.Y.

[73] Assignee: Eastman Kodak Company, Rochester, N.Y.

[21] Appl. No.: 296,774

[22] Filed: Aug. 26, 1994

[51] Int. Cl.[6] ..... G03C 5/18; G03C 5/26

[52] U.S. Cl. ..... 430/449; 430/538; 430/523; 430/531; 430/536; 430/539

[58] Field of Search ..... 430/538, 531, 430/536, 539, 523, 449

[56] References Cited

U.S. PATENT DOCUMENTS

| | | | |
|---|---|---|---|
| 2,358,056 | 7/1940 | Clark | 430/536 |
| 3,277,041 | 10/1966 | Sieg et al. | 524/108 |
| 3,364,028 | 1/1968 | von Konig | 430/613 |
| 4,283,486 | 8/1981 | Aono et al. | 430/505 |
| 4,645,736 | 2/1987 | Anthonsen et al. | 430/538 |
| 4,861,696 | 8/1989 | Tamagawa et al. | 430/138 |
| 5,185,230 | 2/1993 | Bagchi et al. | 430/138 |
| 5,234,804 | 8/1993 | Sato et al. | 430/538 |
| 5,290,671 | 3/1994 | Thomas et al. | 430/512 |

FOREIGN PATENT DOCUMENTS

| | | |
|---|---|---|
| 56-087038 | 7/1981 | Japan . |
| 56-085747 | 7/1981 | Japan . |
| 62-276544 | 12/1987 | Japan . |
| WO93/04399 | 3/1993 | WIPO . |

*Primary Examiner*—Geraldine Letscher
*Attorney, Agent, or Firm*—Paul A. Leipold

[57] ABSTRACT

The invention relates to a method of forming a photographic paper comprising applying to a base paper a polyvinyl alcohol solution of low molecular weight, said solution containing said polyvinyl alcohol in an amount of greater than 15 percent by weight.

19 Claims, No Drawings

PHOTOGRAPHIC PAPER FORMED WITH LOW MOLECULAR WEIGHT POLYVINYL ALCOHOL HAVING LOW OXYGEN PERMEABILITY

FIELD OF THE INVENTION

This invention relates to forming a photographic paper having low oxygen permeability and photographic elements formed utilizing this paper.

BACKGROUND OF THE INVENTION

In formation of photographic materials, there is a continuing desire for such materials to remain uniform over time both prior to exposure and after exposure and development. It is particularly desirable in photographic papers that photographs remain stable when displayed. In order to accomplish this, there has been a continued desire for more stable colors. There has also been a desire to provide increased stability to present color photographs by treating the supports for the images. Such treatments prevent transmission of gases that would react with colorants. Placing overcoats over the images also prevents transmission of oxygen that would react with the colorants of photographs.

It is disclosed in U.S. Pat. No. 4,861,696—Tamagawa et al that the wood pulp of a paper may be partially replaced with a synthetic pulp to lower the oxygen permeability. U.S. Pat. No. 3,364,028—Konig discloses prevention of yellow fog formation by coating a baryta layer.

U.S. Pat. No. 4,283,496—Aono et al discloses the formation of a photographic layer having a single layer of polyvinyl alcohol polymer or other polymer that lowers oxygen transmission through said paper.

U.S. Pat. No. 3,582,337—Griggs et al and U.S. Pat. No. 3,582,339—Martens et al disclose various protective layers for photographic papers.

U.S. Pat. No. 2,358,056—Clark discloses a photographic paper having a layer of barium sulfate dispersed in polyvinyl alcohol between the photographic emulsion and the paper.

U.S. Pat. No. 3,277,041—Sieg et al discloses the use of a cross-linked polyvinyl alcohol polymer to increase the water resistance of a photographic paper.

WO 93/04399—Lacz et al discloses a system to prevent oxygen permeation of color photographic papers by impregnation of the surface of the paper with polyvinyl alcohol. While the Lacz system is successful in producing a paper having low oxygen leak rate, the process for manufacturing is somewhat slow in that two applications of polyvinyl alcohol with a drying step in between are required.

U.S. Pat. No. 5,185,230—Bagchi et al discloses applying an oxygen barrier material around individual coupler or other photographically active particles.

PROBLEM TO BE SOLVED BY THE INVENTION

While the life of photographic images has increased, there still remains a need for improvement in the stability of photographic images. It is particularly desirable that an increase in photographic image life be obtained without necessity to reformulate the color image couplers which have been balanced for pleasing color rendition and an acceptable sensitometric performance. Therefore, it would be desirable if there was a rapid and reliable method of making the paper that provided a barrier to oxygen leakage. It would be desirable if such a paper could be formed at high speed and low cost utilizing relatively low cost materials.

SUMMARY OF THE INVENTION

It is an object of the invention to overcome disadvantages of prior photographic paper and photographic elements.

It is another object of the invention to provide a photographic paper having improved image stability when exposed to light.

It is a further object of the invention to provide a method suitable for high speed formation of a paper having oxygen barrier properties.

These and other objects of the invention are generally accomplished by providing a method of forming a photographic paper comprising applying to a base paper a polyvinyl alcohol of low molecular weight in a water solution that contains greater than 15 percent by weight of said polyvinyl alcohol. The invention further provides a paper comprising wood fibers and polyvinyl alcohol of molecular weight of between a number average of 2,000 and 10,000.

ADVANTAGEOUS EFFECT OF THE INVENTION

The invention has numerous advantages over prior processes and products. The process allows the impregnation of sufficient polyvinyl alcohol polymer to reduce oxygen transmission without interfering with the coating of the normal polyethylene layer that serves as a base for the photosensitive emulsion layers on the photographic paper. Further, the process of the invention allows formation of a photographic element that has improved image stability without a change in the image-forming materials. Further, the photographic elements of the invention have the advantage that the photographic paper may be formed utilizing substantially the current paper formation process, with the addition of a single polyvinyl alcohol polymer solution application apparatus. These and other advantages will be apparent from a detailed description of the invention below. Another advantage is that the oxygen barrier of the invention does not contribute to curl of the photographic paper. Further, the invention makes possible the impregnation of paper with polyvinyl alcohol in a sufficient amount to reduce its oxygen leak rate at a speed substantially the same as the ordinary paper-making process.

DETAILED DESCRIPTION OF THE INVENTION

It has been found that it is possible to incorporate sufficient low molecular weight polyvinyl alcohol into paper in one pass through a solution to achieve a low oxygen leak rate after the paper is dried. The solution of low molecular weight polyvinyl alcohol would be applied to the paper by dipping it in a tank of the solution prior to the final drying of the paper during formation. The low molecular weight polyvinyl alcohol may be loaded into water solutions at high concentrations such that the pick-up of material in one pass is sufficient to provide an improvement in the oxygen barrier properties of the paper sufficient to have an improvement in the photographic affect. The low molecular weight polyvinyl alcohol solutions allow loading of the paper at speeds substantially the same as those operating in the normal paper-making mode without the polyvinyl alcohol added to the paper.

Any low molecular weight polyvinyl alcohol that provides oxygen leak rate protection with rapid absorption into the paper for barrier protection may be utilized. Those suitable have been found to have a molecular weight in the range of between about 2,000 and about 10,000 number average molecular weight with a weight average molecular weight of between 6,000 and 30,000. A preferred number average molecular weight range has been found to be between about 4,000 and about 9,000

There is a preferred range of viscosities of solutions for incorporation into papers. The concentrations of polyvinyl alcohol in water that produce this viscosity depend on the molecular weight of the polyvinyl alcohol, and on the degree of hydrolysis; for example, the viscosity, h, increases approximately exponentially with concentration, c:

$$h=h_o \exp(kc)$$

where the constant k depends on molecular weight and the constant $h_o$ is close to the viscosity of water at the same temperature. Therefore, a given viscosity can be achieved with higher concentrations of lower molecular weight polyvinyl alcohols. These higher solution concentrations result in larger amounts of polyvinyl alcohol remaining in the paper after drying. This invention includes the use of solutions of low molecular weight polyvinyl alcohols that result in high amounts of polyvinyl alcohol being incorporated into the paper in one application, and that these amounts produce papers with desired low porosities, oxygen leak rates, and oxygen permeabilities.

Solution concentrations can be as high as 50 percent by weight polyvinyl alcohol, but are preferably in the range of 20 to 40 percent by weight. These solutions can also contain sodium chloride, to impart antistatic properties to the paper after drying, or sodium bicarbonate for pH control, or surfactants to reduce foaming or other needed ionic or nonionic materials.

This invention includes polyvinyl alcohols with degrees of hydrolysis between about 70 and 100 percent, but preferably greater than about 85 percent. Polyvinyl alcohols with the lower degrees of hydrolysis have larger oxygen permeabilities, but said polyvinyl alcohols also produce solutions of lower viscosity. Thus, larger amounts of less hydrolyzed polyvinylalcohol can be imbibed, and this can compensate for the poorer barrier properties of the dried form of less hydrolyzed polyvinyl alcohol. The polyvinyl alcohol impregnated papers of the invention may be utilized in conventional photographic papers. The formation of such photographic papers utilizing polyvinyl alcohol impregnated paper is disclosed in U.S. Ser. No. 756,262 filed Aug. 19, 1991 and coassigned with this application. It is also disclosed in WO Pat. No. Publication 93/04399 that corresponds to United States patent application also incorporated by reference.

The polyvinyl alcohol polymer is impregnated in any amount that provides substantial oxygen impermeability. Generally a suitable pick-up range is impregnated between about 7 and about 20 weight percent of the dry paper weight for an effective barrier to oxygen infiltration and relatively low cost. A pick up of about 10 to 15 weight percent of the dry impregnated paper weight is preferred for low cost with good oxygen permeability properties. The impregnation of the invention results in a paper that in the preferred embodiment does not have a polyvinyl alcohol layer above the surface but has polyvinyl alcohol impregnation concentrated near both surfaces of the paper. It has been found that the one pass of the paper in polyvinyl alcohol solution results in sufficient pick-up of polyvinyl alcohol to provide the oxygen impermeability desired. Generally the range of polyvinyl alcohol in the solution is between about 20 and about 50 weight percent with a preferred amount being about 20 to about 40 weight percent for adequate impregnation of the paper. The PVA sizing solution also generally contains up to 1 percent sodium chloride based on the PVA solids. The sodium chloride provides internal conductivity to the paper such that it is not susceptible to static electricity buildup. A preferred solution viscosity of the polyvinyl alcohol impregnation solution is between about 200 and about 500 centipoise at 50° C.

Impregnation of the polyvinyl alcohol into the paper is such that an oxygen impermeable (zone) is created on at least the side onto which the photographic emulsions will be placed. A suitable temperature for the PVA impregnation is about 50° C. Generally, the PVA sizing as set forth above will result in a zone of substantially complete impregnation of at least the upper 40 microns on the emulsion side of the paper. Ordinarily the emulsion side is the side of the paper that was against the wire of the paper-making machine. The side of the paper that was against the wire during paper formation is called the wire side, and the other side of the paper is called the face side. The amount of impregnation of polyvinyl alcohol on the back side (face side) of the paper away from the emulsions is less critical, although substantial impregnation is considered necessary to prevent curl. Generally, conventional weight photographic paper has an overall thickness of about 200 microns, and the sizing method of the invention will result in face side impregnation of at least about 20 microns. It is preferred that impregnation be at least 50 microns on the emulsion (wire) side of the paper in order to provide an adequate oxygen barrier. The phrase "substantially complete impregnation" is intended to indicate that substantially all voids between wood fibers have been filled by the polyvinyl alcohol polymer.

The sizing operation also may apply fillers, pigment, brighteners, dyes, hardeners, and other addenda typically utilized in size solutions.

Non-contact drying immediately after polyvinyl alcohol impregnation is applied to dry the surface of the paper to be non-tacky such that contact with the dryer drums does not cause adhesion of wet polymer to the dryer drums. Further, the non-contact drying serves to aid in concentration of polyvinyl alcohol nearer the surface of the paper such that oxygen impermeability results with less use of polyvinyl alcohol. The non-contact drying preferably removes at least about one-third of the water in the support.

It is preferred that the paper prior to any impregnation with polyvinyl alcohol be dried to below about 10 percent moisture and preferably below about 5 percent moisture for greater polyvinyl alcohol pick-up when dipped into the polyvinyl alcohol solution. It is particularly desirable that non-contact drying be carried out, as there is a greater tendency for the polyvinyl alcohol solution at the surface to stick to the drying drums if it is tacky upon contact with them.

Generally the paper sheet that is impregnated with the polyvinyl alcohol may be of any desired basis weight. It is generally preferred that the paper sheet have a basis weight of between about 25 and about 50 lbs/1000 sq. ft to provide a conventional feel and handling to the impregnated paper. A heavier weight paper of up to 80 lbs/1000 sq. ft. may be preferred for display purposes.

The polyvinyl alcohol impregnated papers can be utilized in the formation of photographic elements which, after exposing and processing, generate colored images which are surprisingly stable to light. Furthermore, the images exhibit neutral fade to light; the yellow, magenta, and cyan image dyes fade at the same rate, thus prolonging the useful lifetime of the print. In a typical color print, the light stabilities of the yellow and magenta image dyes are usually inferior to the light stability of the cyan image dye leading to an objectionable non-neutral fade of the color print. For color prints formed from impregnated papers in this invention, however, the light stabilities of the yellow and magenta image dyes are improved substantially, while the light stability of the cyan image dye remains largely unaffected leading to greater image stability and neutral color fade. The yellow and magenta image dyes which benefit from the impregnated supports are formed by the reaction of oxidized color development agents with 2- and 4-equivalent image couplers such as open-chain ketomethylenes, pyrazolones, pyrazolotriazoles, and pyrazolobenzimidazoles. Typically, such image couplers are ballasted for incorporation in high boiling coupler solvents.

Couplers which form magenta dyes upon reaction with oxidized color developing agents are described in such representative patents and publications as: U.S. Pat. Nos. 2,600,788; 2,369,489; 2,343,703; 2,311,082; 3,152,896; 3,519,429; 3,062,653; 2,908,573, and "Farbkuppler-eine Literaturubersicht," published in Agfa Mitteilungen, Band III, pp. 126–156 (1961).

Couplers which form yellow dyes upon reaction with oxidized color developing agents are described in such representative patents and publications as: U.S. Pat. Nos. 2,875,057; 2,407,210; 3,265,506; 2,298,443; 3,048,194; 3,447,928; 5,021,333, and "Farbkuppler-eine Literaturubersicht," published in Agfa Mitteilungen, Band III, pp. 112–126.

In addition, other image couplers which can be useful are described in the patents listed in *Research Disclosure*, December, 1989, Item No. 308119, paragraph VII D, the disclosure of which is incorporated herein by reference.

Another key element to enhancing the useful lifetime of a color print is the reduction or elimination of the yellow stain which can form on prolonged exposure to light. This can be accomplished by coating a sufficient quantity of an ultraviolet light absorber (UVA) in the photographic element. Typically the UVA's are substituted phenylbenzotriazoles which are described in such representative patents as U.S. Pat. Nos. 4,853,471; 4,790,959; 4,752,298; 4,973,701; 4,383,863; 4,447,511; and references listed therein. Specific UVA's described in this invention are shown in structures V, U, and R. The preferred UVA's are the liquid type to minimize crystallization and surface blooming problems observed with solid UVA's.

Various layers to convert the paper support into a light reflecting print material, such as silver halide emulsion layers, subbing layers, interlayers, and overcoat layers are provided onto the paper support of the invention. The paper of the invention when used in a photographic element would be coated with a layer of silver halide emulsion containing cyan forming color coupler, a layer of silver halide emulsion containing a magenta dye forming coupler, and a layer of silver halide emulsion containing a yellow dye forming coupler. Also conventional polyethylene extrusion coated layers may be provided on the paper support. The silver halide emulsion employed in the elements of this invention can be either negative-working or positive-working. Suitable emulsions and their preparation are described in sections I and II of the *Research Disclosure*, December, 1978, Item No. 17643, published by Industrial Opportunities, Ltd., The Old Harbourmaster's, 8 North Street, Emsworth, Hants, P010 7DD, England. The silver halide emulsions employed in the present invention preferably comprise silver chloride grains which are at least 80 mole percent silver chloride and the remainder silver bromide.

The following examples are intended to be illustrative and not exhaustive of the formation of polyvinyl alcohol impregnated papers in accordance with the invention:

EXAMPLES

A group of polyvinyl alcohols was evaluated for their ability to provide an improvement in oxygen leak rate after a single pass through a bath of polyvinyl alcohol during formation of the paper. A polyvinyl alcohol of the earlier referenced Lacz et al application was utilized as a comparison. Also for comparison, the polyvinyl alcohol was applied to a single side of the paper to determine whether single-side application would provide sufficient impregnation for oxygen barrier properties. The photographic paper support by the examples was produced by refining a pulp furnish of 50% bleached hardwood kraft, 25% bleached hardwood sulfite, and 25% bleached softwood sulfite through a double disk refiner, then a Jordan conical refiner to a Canadian Standard Fineness of 200 cc. To the resulting pulp furnish was added 0.2% alkyl ketene dimer, 1.0% cationic cornstarch, 0.5% polyamideepichlorohydrine, 0.26 anionic polyacrylamide, and 5.0% $TiO_2$ on a dry weight basis. An about 35.0 lbs. per 1,000 sq. ft. (ksf) bone dry weight base paper was made on a fourdrinier paper machine, wet pressed to a solid of 42%, and dried to a moisture of 3% using steam-heated dryers achieving a Sheffield Porosity of 160 Sheffield Units and an apparent density 0.70 g/cc. The paper base was then surface sized using a vertical tub size press with a polyvinyl alcohol solution to achieve the desired loading. The surface sized support was calendered to an apparent density of 1.00 gm/cc. This support was extrusion coated on the emulsion-facing side with polyethylene containing 12.5% $TiO_2$, and other addenda at 5.6 lb./ksf coverage. The opposite side was coated at 6.0 lb./ksf with just polyethylene.

Table 1 lists a group of suitable polyvinyl alcohol materials of low molecular weight indicating their properties. Table 2 is a listing of the results of the tests. As illustrated by Table 2, a leak rate of below about 100 is considered as a test result that is indicative of a possibly commercially suitable material. While it is noted that in the above-referenced Lacz et al application, a leak rate of below 30 $mL/m^2$ per day was considered as necessary for substantially improved photographic performance, it is known that materials formed by this test apparatus that have an oxygen leak rate of below about 100 are likely when formed upon a commercial machine to reach the preferred oxygen leak rate of below 25 $mL/m^2$ per day. Therefore, results below are considered satisfactory if the leak rate is below about 100 $mL/m^2$ per day, as this is equivalent to a production paper of oxygen leak rate of below 25 $mL/m^2$ per day.

TABLE 1

| | | PVA SPECIFICATIONS | | | | |
|---|---|---|---|---|---|---|
| Manufacturer | Trade Name | Percent Hydrolysis | h (cps) 4 wt. % | Molecular Weight $M_n$ | $M_w$ | $M_z$ |
| Sp[2][1] | 335 | 78% | 3.1 | 2400 | 6000 | 11300 |
| | 336 | 88% | 3–4 | 2900 | 7100 | 13900 |
| Air Products | Airvol 103 | 98–99% | 3.4–4.2 | 6100 | 17500 | 31800 |
| | Airvol 107 | 98–99% | 5.4–6.5 | 11500 | 30700 | 54000 |
| | Airvol 203 | 87–89% | 3–4 | 5300 | 15000 | 29000 |
| | Airvol 205 | 87–89% | 5–6 | 9200 | 27100 | 51200 |
| | Elvanol | 87–89% | 5–6 | 9600 | 28800 | 57000 |

TABLE 1-continued

| Manufacturer | Trade Name | PVA SPECIFICATIONS Percent Hydrolysis | h (cps) 4 wt. % | Molecular Weight $M_n$ | $M_w$ | $M_z$ |
|---|---|---|---|---|---|---|
| | 51-05 | | | | | |
| Hoechst-Celanese | Mowiol 383 | 82.6 ± 2.2 | 2.8 ± 10.3 | 5600 | 13900 | 25500 |
| | Mowiol 488 | 87.7 ± 1.0 | 4 ± 0.5 | 8300 | 21600 | 39800 |
| Nippon-Gohsei | NL-05 | 98.5–100 | 4.6–6 | 10300 | 28300 | 53000 |

[1] $SP^2$ denotes Scientific Polymer Products.

TABLE 2

(UPTAKE, POROSITY, AND PERMEABILITY DATA)

| Ex. | PVA | Wt. %[a] | Sides | Uptake[b] gm $ft^{-2}$ | Uptake[b] Wt. % | Sheffield Porosity[c] | Oxygen Permeability[d] | Leak Rate[d] |
|---|---|---|---|---|---|---|---|---|
| 1 Co | T330H[e] | 10 | 1 | 0.2 | 1 | 138 ± 5 | 49 ± 3 | 320 |
| 2 Co | | 10 | 2 | 0.8 | 5 | 70 ± 50 | 6 ± 3 | 120 |
| 3 Co | | 10 | 2 | 1.0 | 7 | 35 ± 20 | 7 ± 1 | 210 |
| 4 Co | | 10 | 2 | 0.5 | 3 | 70 ± 15 | 21 ± 2 | 100 |
| 5 Co | | 10 | 2 | 0.5 | 3 | 60 ± 5 | 20 ± 1 | 120 |
| 6 Co | | 10 | 2 | 0.6 | 4 | 78 ± 3 | 19 ± 1 | 130 |
| 7 Co | Wire side | 10 | 2 × 2[f] | 2.1 | 14 | 4 ± 1 | 3 ± 0 | 19 |
| 8 Co | Face side | 10 | 2 × 2[f] | 2.1 | 14 | 4 ± 1 | 8 ± 2 | 160 |
| 9 | Airvol 103 | 22 | 1 | 0.2 | 1 | 135 ± 3 | 39 ± 2 | 340 |
| 10 | | 22 | 2 | 1.4 | 9 | 10 ± 3 | 18 ± 0 | 95 |
| 11 | Airvol 107 | 15 | 1 | 0.2 | 1 | 100 ± 20 | 46 ± 2 | 280 |
| 12 | | 15 | 2 | 0.8 | 4 | 30 ± 10 | 19 ± 1 | 160 |
| 13 | | 20 | 1 | 0.5 | 3 | 48 ± 4 | 35 ± 4 | 99 |
| 14 | | 20 | 2 | 1.0 | 7 | 8 ± 2 | 15 ± 5 | 60 |
| 15 | Airvol 203 | 27 | 1 | 1.1 | 7 | 90 ± 5 | 35 ± 1 | 290 |
| 16 | | 27 | 2 | 2.0 | 13 | 4 ± 1 | 7 ± 2 | 40 |
| 17 | Airvol 205 | 21 | 1 | 1.1 | 7 | 58 ± 7 | 39 ± 5 | 270 |
| 18 | | 21 | 2 | 1.5 | 10 | 1 ± 1 | 13 ± 3 | 41 |
| 19 | Elvanol | 22 | 1 | 0.6 | 4 | 50 ± 3 | 32 ± 1 | 270 |
| 20 | 51-05 | 22 | 2 | 1.4 | 9 | 2 ± 1 | 13 ± 2 | 41 |
| 21 | Mowiol 383 | 28 | 1 | 0.8 | 5 | 97 ± 7 | 61 ± 1 | 340 |
| 22 | | 28 | 2 | 2.0 | 13 | 4 ± 1 | 26 ± −0 | 53 |
| 23 | Mowiol 488 | 25 | 1 | 0.8 | 5 | 55 ± 1 | 50 ± 5 | 230 |
| 24 | | 25 | 2 | 1.7 | 11 | 2 ± 1 | 15 ± 2 | 44 |
| 25 | Mowiol 480 | 23 | 1 | 0.6 | 4 | 19 ± 1 | 33 ± 9 | 107 |
| 26 | | 23 | 2 | 1.6 | 11 | 6 ± 1 | 14 ± 1 | 92 |
| 27 | Mowiol 498 | 23 | 1 | 0.4 | 3 | 140 ± 5 | 34 ± 12 | 112 |
| 28 | | 23 | 2 | 1.5 | 10 | 88 ± 2 | 20 ± 2 | 125 |
| 29 | NL-05 | 20 | 1 | 0.4 | 3 | 230 ± 10 | 49 ± 2 | 350 |
| 30 | | 20 | 2 | 1.4 | 9 | 60 | 4 ± 1 | 137 |
| 31 | | 20 | 2 | 1.4 | 9 | 45 | 1 ± 0 | 70 |
| 32 | | 20 | 2 | 1.3 | 9 | 52 ± 6 | 15 ± 2 | 94 |
| 33 | $SP^2$ 335 | 30 | 1 | 1.4 | 9 | 60 ± 20 | 13 ± 7 | 130 |
| 34 | | 30 | 2 | 2.4 | 16 | 5 | 4 ± 4 | 30 |
| 35 | | 35 | 1 | 1.2 | 8 | 75 ± 15 | 44 ± 4 | 220 |
| 36 | | 35 | 2 | 2.6 | 17 | 8 ± 2 | 3 ± 3 | 23 |
| 37 | | 40 | 1 | 1.4 | 9 | 37 ± 5 | 25 ± 1 | 200 |
| 38 | | 40 | 2 | 2.9 | 19 | 2 ± 2 | 0 | 6 |
| 39 | $SP^2$ 336 | 30 | 1 | 1.0 | 7 | 70 ± 20 | 7 ± 0 | 170 |
| 40 | | 30 | 2 | 2.1 | 14 | 10 | 4 ± 0 | 130 |
| 41 | | 35 | 1 | 1.0 | 7 | 118 ± 7 | 37 ± 1 | 230 |
| 42 | | 35 | 2 | 2.6 | 17 | 12 ± 5 | 6 ± 3 | 20 |
| 43 | | 40 | 1 | 1.6 | 11 | 42 ± 6 | 26 ± 1 | 140 |
| 44 | | 40 | 2 | 3.5 | 23 | 4 ± 3 | 1 ± 1 | 5 |

a) Weight percent in water to give a viscosity of 300 centipoise at 50° C.
b) Gram per square foot (95% confidence limits ±0.6) of PVA (excluding water)
c) After calendering
d) mL $m^{-2}$ $day^{-1}$
e) Control PVA - medium molecular weight manufactured by Nippon Goshi
f) Refers to two passes, two sided
Co) Comparison - medium molecular weight PVA (number average 30,000 and weight average 158,000)

The testing for oxygen leak rate, oxygen permeability, and Sheffield porosity was carried out. Sheffield porosity was determined by the Tappi Standard T548 pm-88 and are given in Sheffield Units. Oxygen permeabilities are determined according to the specification in the ASTM Standard D3985-81.

The oxygen leak rate was measured, using the same apparatus and test conditions as in WO93/04399 and U.S. Ser. No. 039,340 filed Apr. 16, 1993 of Lacz et al hereby incorporated by reference. Nitrogen gas was introduced as the carrier gas in both the upper and lower chambers. After a suitable amount of time (30–180 minutes), the oxygen sensor was inserted into the lower chamber exhaust stream. Once equilibrium was established, the rate of oxygen reaching the sensor was recorded as the oxygen leak rate. The oxygen leak rate thus represents the rate that oxygen is reaching the sensor from 1) outgassing of the sample, 2) leaks in the system, and 3) leaks through the edge of the paper and diffusion through the polyethylene layer.

The invention has been described in detail with particular reference to preferred embodiments thereof, but it will be understood that variations and modifications can be effected within the spirit and scope of the invention.

We claim:

1. A method forming a paper, for use in a photographic paper support for a photographic element comprising applying to a paper a polyvinyl alcohol solution of low molecular weight, said solution containing said polyvinyl alcohol in an amount of greater than 15 percent by weight with the proviso that the number average molecular weight of said polyvinyl alcohol is between about 2,000 and 10,000.

2. The method of claim 1 wherein the viscosity said polyvinyl alcohol is 200 to 500 centipoise at 50° C.

3. The method of claim 1 wherein said base paper is coated in one pass.

4. The method of claim 3 wherein said polyvinyl alcohol is applied to both sides of said base paper.

5. The method of claim 1 wherein said polyvinyl alcohol solution comprises between about 20 and about 50 percent by weight polyvinyl alcohol.

6. The method of claim 1 wherein said polyvinyl alcohol solution comprises between about 20 and about 40 percent by weight polyvinyl alcohol.

7. The method of claim 1 wherein the solution of said polyvinyl alcohol has a temperature of about 50° C.

8. The method of claim 1 wherein the pick-up of polyvinyl alcohol is between about 7 percent and 20 percent of the dry impregnated paper weight.

9. The method of claim 8 further comprising drying said paper and after drying said polyvinyl alcohol is concentrated near the surface of said paper.

10. The method of claim 1 wherein there is no layer of polyvinyl alcohol above the surface of the paper.

11. The method of claim 1 wherein said polyvinyl alcohol has a number average molecular weight of between about 4,000 and 9,000.

12. An imaging element comprising at least one silver halide emulsion layer containing dye forming coupler, overlaying a paper support wherein said paper support comprises paper comprising wood fibers and polyvinyl alcohol of molecular weight of between a number average of 2,000 and 10,000.

13. The element of claim 12 wherein said polyvinyl alcohol comprises between about 7 and about 20 weight percent of the paper support.

14. The element of claim 12 wherein there is no layer of polyvinyl alcohol on the surface of the paper.

15. The element of claim 12 wherein said paper support has an oxygen leak rate of less than 25 $mL/m^2$ per day.

16. The element of claim 12 wherein said polyvinyl alcohol is concentrated near the surfaces of the paper that forms at least part of said paper support.

17. The element of claim 16 wherein there is no layer of polyvinyl alcohol above the surface of said paper.

18. An imaging element comprising at least one layer of silver halide emulsion layer containing dye forming coupler overlaying a paper support comprising paper, said paper comprising wood fibers and polyvinyl alcohol of molecular weight of between a number average of 2,000 and 10,000 wherein said polyvinyl alcohol comprises between about 7 and about 20 weight percent of said paper, said paper support has an oxygen leak rate of less than 25 $mL/m^2$ per day, and said polyvinyl alcohol is concentrated near the surfaces of said paper.

19. The element of claim 18 wherein said paper support further comprises polyethylene layers on each side of said paper.

* * * * *